United States Patent [19]

Burrows et al.

[11] Patent Number: 5,042,857

[45] Date of Patent: Aug. 27, 1991

[54] ELECTRICALLY RELEASABLE DOOR LOCKING MEANS

[75] Inventors: Leslie Burrows; Donald T. Talbot, both of Willenhall, England

[73] Assignee: Yale Security Products Limited, England

[21] Appl. No.: 409,810

[22] Filed: Sep. 20, 1989

[30] Foreign Application Priority Data

Sep. 21, 1988 [GB] United Kingdom ..... 8822198
Oct. 22, 1988 [GB] United Kingdom ..... 8824807

[51] Int. Cl.[5] ..... E05C 19/00
[52] U.S. Cl. ..... 292/341.16; 292/201
[58] Field of Search ..... 292/201, 216, 341.15, 292/341.16, 341.17

[56] References Cited

U.S. PATENT DOCUMENTS 1,274,381 8/1918 Brooks ..... 292/341.16
3,638,984 2/1972 Davidson ..... 292/341.16
3,758,142 9/1973 Gartner ..... 292/341.16
4,017,107 4/1977 Hanchett ..... 292/341.16
4,471,983 9/1984 Bischoff et al. ..... 292/341.16

FOREIGN PATENT DOCUMENTS 1321834 7/1973 United Kingdom ..... 292/216

*Primary Examiner*—Eric K. Nicholson
*Attorney, Agent, or Firm*—Andrus, Sceales, Starke & Sawall

[57] ABSTRACT

An electrically locked striker for a door locking means comprising a striker body shaped for mounting in a recess in a door frame with one face of said body substantially flush with the frame, a striker pivotally mounted on said body for angular movement about an axis perpendicular to said face, spring means urging said striker towards a locking position, and a bolt movable by electrically energizable means in a direction parallel to said face, said bolt being engageable in a recess in said striker to prevent rotation thereof.

6 Claims, 2 Drawing Sheets

ELECTRICALLY RELEASABLE DOOR LOCKING MEANS

This invention relates to an electrically releasable door locking means.

Many proposals have now been made for electronically controlled door locks. To avoid the need for electrical wiring to be passed around the hinged edge of a door, it has already been proposed to provide electrical lock release means in a lock striker rather than in the lock mechanism itself. With this arrangement the lock can be released from inside the secured area by means of a conventional knob or handle operating the lock, but, from outside, access is obtained by electronic means which releases an electrically locked striker.

The present invention has for its object to provide a convenient and secure form of electrically locked striker.

In accordance with the invention there is provided a striker body shaped for mounting in a recess in a door frame with one face of said body substantially flush with the frame, a striker pivotally mounted on said body for angular movement about an axis perpendicular to said face, spring means urging said striker towards a locking position, and a bolt movable by electrically energisable means in a direction parallel to said face, said bolt being engageable in a recess in said striker to prevent rotation thereof.

Figure 2:
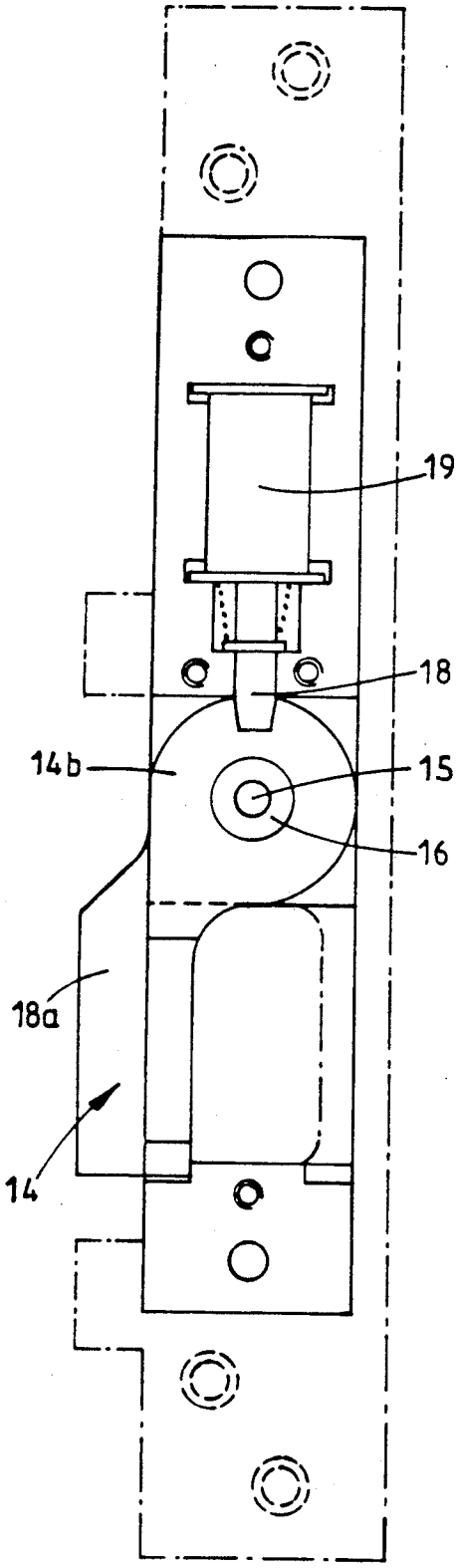
Figure 1:
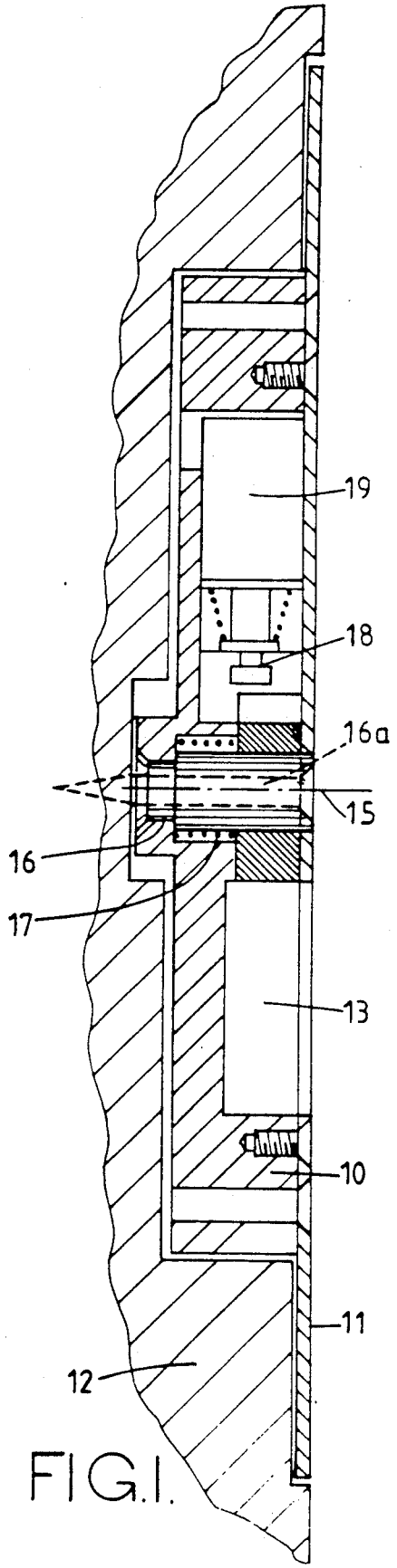
Figure 3:
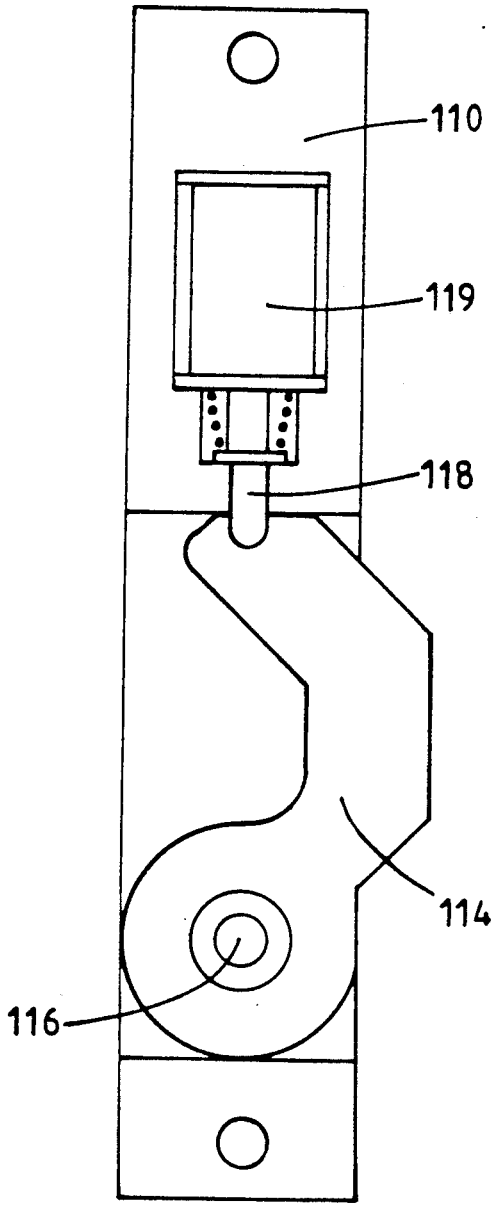

An example of the invention is shown in the accompanying drawings in which:

FIG. 1 is a longitudinal section through an example of an electrically releasable striker device in accordance with the invention, FIG. 2 is an elevation of the striker device, with a cover plate thereof removed, and FIG. 3 a view like FIG. 2 but showing another example of the invention.

The striker device shown comprises a body 10 and a cover plate 11 attached to a face of the body. The body is intended to be mounted in a recess in a door frame member 12, with the face of the body or, more specifically, the outer face of the cover plate substantially flush with the frame member.

The body is formed adjacent one end with a recess 13 which receives, in use, the bolt of a coacting lock mounted on the door. This recess is bounded at one side by a striker 14 which is pivotally mounted on the body 10 so as to be angularly movable about an axis 15 perpendicular to the cover plate 11 and the face of the body against which the cover plate is secured. The striker is pivotally mounted on a substantial pivot pin 16 riveted to the body 10 and formed with a through bore 16*a* through which a fixing screw can be inserted to attach the device to the door frame, other fixing screws also being employed.

The striker 14, itself, is also of substantial construction and may, if desired, have a bevelled face 18*a* to cause or assist in the retraction of the lock bolt as the door is closed in use. The striker 14 has a hub portion 14*b* through which the pin 16 extends and this hub portion has a locking recess which is aligned (in the closed position of the striker, to which it is urged by a torsion spring 17 in the hub) with a bolt 18, provided on the plunger of a solenoid 19. This solenoid is housed in another recess in the body 10 and is covered by the cover plate 11.

The solenoid may be arranged to urge the bolt into the recess or to withdraw it depending on the user requirements.

In the arrangement shown in FIG. 3, the body 110 of the striker device is similar to that shown in FIGS. 1 and 2 and provides a mounting for a solenoid 119 which has a bolt 118 on its plunger. However, the striker 114 is mounted with its pivot pin 116 spaced from the bolt 118. In the closed position shown, the striker 114 extends towards the solenoid 118 and is held in position by the bolt 118 engaging in a recess in the end of the striker.

With this arrangement the bolt 118 engages the striker 114 at a distance from the pivotal axis much greater than the corresponding distance in the construction shown in FIGS. 1 and 2.

We claim:

1. An electrically locked striker for a door locking means comprising a striker body shaped for mounting in a recess in a door frame with one face of said body substantially flush with the frame, a striker pivotally mounted on said body for angular movement about an axis perpendicular to said face, spring means urging said striker into a locking position when the door is closed and open, and a bolt movable by electrically energisable means in a direction parallel to said face, said bolt being engageable in a recess in said striker to prevent rotation thereof.

2. An electrically locked striker device for a coacting door bolt of the type extendable perpendicularly from the edge face of the door and into a door frame, said device comprising a striker body shaped for mounting in a recess in said door frame with one face of said body substantially flush with the frame in opposing face-to-face relationship with said door edge face when the door is closed, a striker pivotally mounted on said body for angular movement about an axis perpendicular to said one face, spring means urging said striker towards a locking position, and a bolt movable by electrically energisable means in a direction parallel to said face, said bolt being engageable in a recess in said striker to prevent rotation thereof.

3. An electrically locked striker for a door locking means comprising a striker body shaped for mounting in a rebate in a door frame with one face of said body substantially flush with the frame, said face of said striker body being formed with a lock-bolt receiving recess, a striker pivotally mounted on said striker body for movement about an axis perpendicular to said face, spring means urging said striker towards a locking position, a bolt movable by electrically energisable means in a first direction parallel to said face, said bolt being engageable in a recess in said striker to prevent rotation thereof out of said locking position, said striker in said locking position blocking movement of a lock-bolt received in said lock-bolt receiving recess in a second direction mutually perpendicular to said striker axis and said first direction.

4. An electrically locked striker as claimed in claim 3 in which said electrically energisable means comprises a solenoid mounted in a recess in said striker body.

5. An electrically locked striker as claimed in claim 4 in which said striker has a hub portion by means of which it is pivotally mounted on the striker body, said recess in the striker being formed in the hub.

6. An electrically locked striker as claimed in claim 4 in which said striker is of elongated form so as to have two opposite end portions and is pivotally connected to the striker body by one end portion, said recess in the striker being formed in the other end portion.

* * * * *